United States Patent [19]

Gherardi

[11] Patent Number: 4,664,249

[45] Date of Patent: May 12, 1987

[54] TURN AROUND DEVICE FOR FILTER CIGARETTES

[75] Inventor: Gian L. Gherardi, Medicina, Italy

[73] Assignee: Sasib S.p.A., Bologna, Italy

[21] Appl. No.: 679,357

[22] Filed: Dec. 7, 1984

[30] Foreign Application Priority Data

Dec. 29, 1983 [IT] Italy ..... 12714 A/83

[51] Int. Cl.[4] ..... B65G 47/24

[52] U.S. Cl. ..... 198/410; 198/449; 198/458; 198/951; 131/282

[58] Field of Search ..... 198/410, 404, 449, 450, 198/951, 689, 480, 412, 408, 458; 131/282, 283

[56] References Cited

U.S. PATENT DOCUMENTS

| | | | |
|---|---|---|---|
| 3,372,702 | 3/1968 | Bohn et al. | 198/458 |
| 3,412,842 | 11/1968 | Molins et al. | 198/404 |
| 3,417,855 | 12/1968 | Liedtke | 198/951 |
| 3,485,337 | 12/1969 | Everhart | 198/449 |
| 3,583,546 | 6/1971 | Koop | 198/404 |
| 3,625,103 | 12/1971 | Giatti | 198/449 |
| 3,973,671 | 8/1976 | Schwenke | 198/404 |
| 4,211,318 | 7/1980 | Verjux | 198/404 |

FOREIGN PATENT DOCUMENTS

| | | | |
|---|---|---|---|
| 1532163 | 2/1973 | Fed. Rep. of Germany | 198/410 |
| 781944 | 10/1965 | Italy . | |
| 1095529 | 12/1967 | United Kingdom . | |

*Primary Examiner*—Robert J. Spar
*Assistant Examiner*—Lyle Kimms
*Attorney, Agent, or Firm*—Spencer & Frank

[57] ABSTRACT

A turn around device that is designed for changing two side-by-side parallel rows of filter tipped cigarettes, which are formed by a succession of parallel pairs of co-axial cigarettes (S1, S2) with their filters in facing relation, into only one row of parallel cigarettes (S1, S2') with their filters being oriented in the same direction, comprises two fluted, conical, suction, turn around drums (5, 6), of which one takes the cigarettes (S2) forming one of the two cigarette rows, and lays them in a turned around position, i.e., rotated by 180° about a transverse axis thereof, between the cigarettes (S1) of the other cigarette row. Between the point at which the cigarettes (S2) to be turned around are withdrawn, and the first turn around conical drum (5), and between the second turn around conical drum (6) and the point in which the turned around cigarettes (S2') are laid, intermediate transfer device (10, 24) are interposed, consisting of a conical transfer drum (10) and a cylindrical transfer drum (24), of which at least one determines an axial cigarette displacement being adapted for counterbalancing the axial displacement as determined by the conical transfer drums, whereby the turned around cigarettes (S2') will be laid and positioned into alignment with the not turned around cigarettes (S1).

7 Claims, 2 Drawing Figures

S2
A
S1
3
S2
22
11
10
12
32
S2'
23
21
18
24
14
13
125
31
20
17
30
28
29
13
14
27
126
18
19
S2
12
32
S2'
7
5
11
B
6
105
106
S2
8
15
16
25
9
26

TURN AROUND DEVICE FOR FILTER CIGARETTES

BACKGROUND AND SUMMARY OF THE INVENTION

This invention relates to a device for turning around filter tip cigarettes, which is designed for changing two side-by-side parallel rows of filter cigarettes, which are formed by a succession of parallel pairs of co-axial cigarettes with their filters in facing relation, into only one row of parallel cigarettes with their filters being oriented in the same direction, which device comprises two fluted, conical, preferably suction, turn around drums, of which one takes the cigarettes forming one of the two cigarette rows, and lays them in a turned around position, i.e., rotated by 180° about a transverse axis thereof, between the cigarettes of the other cigarette row.

In the turn around devices of the type as above disclosed, which are, for example, known from the Italian Pat. No. 781,944, the ends of the not turned around cigarettes and the ends of the turned around cigarettes that are inserted between the not turned around cigarettes, are not into mutual alignment, but are offset in the longitudinal direction of the cigarettes, i.e., transversely to the single cigarette row, because the point of coincidence of the ideal vertices of the two turn around conical drums must be necessarily shifted with respect to the plane of substantial contact between the facing filters of the pairs of cigarettes forming the two cigarette rows, in order to avoid any interference between the cigarettes. Consequently, when using the known turn around devices of the above-disclosed type, special cigarette-aligning means must be provided for the cigarettes being oriented with their filters in the same direction and alternately belonging to the not turned around and to the turned around row of cigarettes, in order to form one single cigarette row. These cigarette-aligning means consist of small pistons which, for example, are fitted on a cigaratte-conveying fluted drum, or of a stationary frontal cam which, for example, is co-axial to a cigarette-conveying fluted drum. The cigarette-aligning pistons however are complicated in construction, and are also scarcely reliable since their movement may be disturbed by the tobacco dust. The cigarette-aligning cam instead, causes some difficulties at high speeds, also on account of the fact that the degree of the longitudinal displacement of the cigarettes to be aligned is quite important.

The object of the present invention is to eliminate the said drawbacks by having the cigarettes of the turned around cigarette row laid between the cigarettes of the not turned around cigarette row, with the ends of the turned around cigarettes being already aligned with the ends of the not turned around cigarettes.

To this end, according to the invention, between the point at which the cigarettes to be turned around are withdrawn, and the first conical turn around drum, and/or between the second conical turn around drum and the point in which the turned around cigarettes are laid, intermediate transfer means are interposed, of which at least one determines an axial displacement of the cigarettes, which is adapted for counterbalancing the axial displacement as determined by the conical turn around drums, whereby the turned around cigarettes are laid and positioned into alignment with the not turned around cigarettes.

Preferably, according to one embodiment of the invention, the intermediate transfer means that is associated to one of the conical turn around drums, for example the transfer means arranged between the point of withdrawal of the cigarettes to be turned around and the first conical turn around drum, is a fluted, conical, preferably suction, transfer drum, while the intermediate transfer means that is associated to the other conical turn around drum, for example the transfer means arranged between the second conical turn around drum and the point in which the turned around cigarettes are laid, is a fluted, cylindric, preferably suction, transfer drum. Of course, the intermediate transfer means arranged upstream and downstream of the two conical turn around drums, may be both fluted, conical, preferably suction, transfer drums.

BRIEF DESCRIPTION OF THE DRAWINGS

These and other features of the invention, and the advantages arising therefrom, will clearly appear in the following specification of one preferred embodiment thereof, which is diagrammatically shown by way of example in the accompanying drawings, in which.

DESCRIPTION OF THE PREFERRED EMBODIMENT

Figure 1:
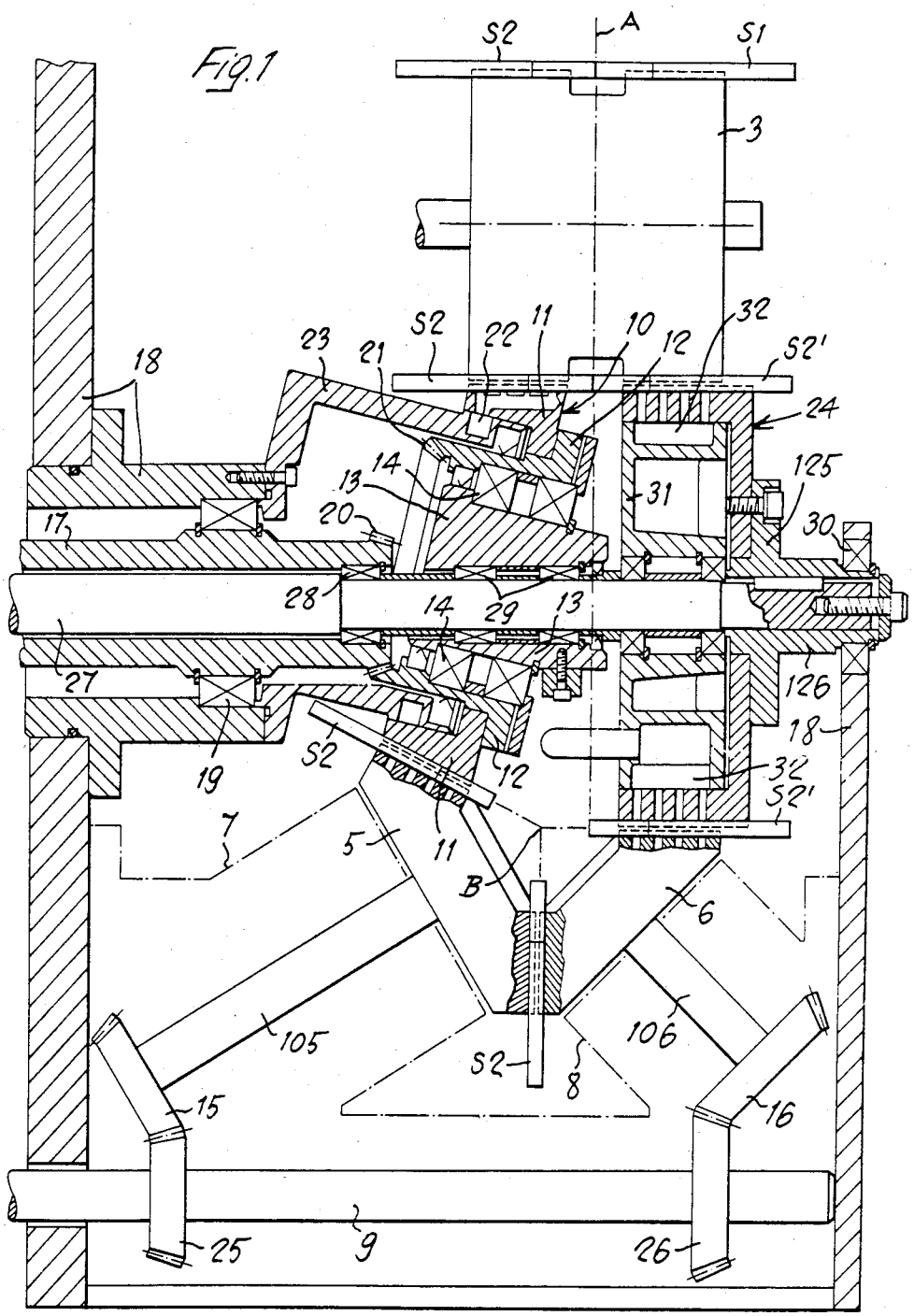
FIG. 1 shows a vertical section through a cigarette turn around apparatus according to the invention.

In the figures, reference numeral 1 denotes a fluted suction drum rotating in the direction of the arrow and receiving in each flute an assembly S1–S2 consisting of two co-axial cigarettes connected to an interposed double filter. These cigarette assemblies S1–S2 are divided into two aligned, filter tipped individual cigarettes S1 and S2 by the rotating blade 2 severing them intermediately of the interposed double filter. These aligned cigarette pairs S1 and S2 with their filters in facing relation and substantially abutting each other at the cutting line A, form on drum 1 two respective side-by-side parallel cigarette rows.

The cigarette pairs S1, S2 in both of said rows are transferred to a successive fluted suction drum 3. The pitch of the flutes in said drum 3 is half the pitch of the flutes in the preceding drum 1, so that between every two succeeding pairs of aligned cigarettes S1 and S2 laid on drum 3 with their filters in facing relation, an empty flute is left in said drum 3.

Figure 2:
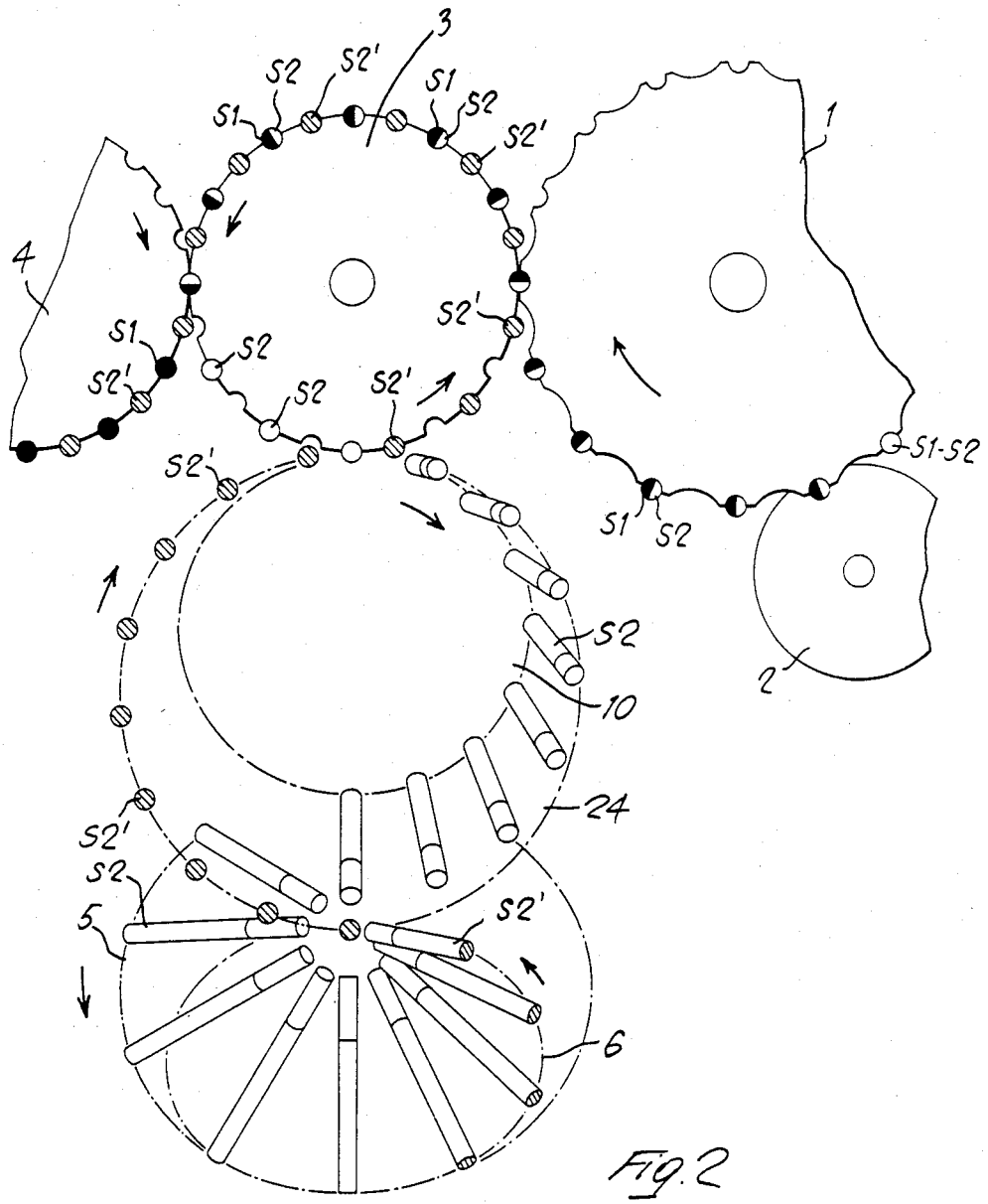
FIG. 2 diagrammatically shows the cigarette path through the turn around apparatus according to FIG. 1.

The cigarettes S1 forming one cigarette row on drum 3, such as, for example, the cigarette row shown on the left-hand side at the top of FIG. 2, are transferred from drum 3 directly to a successive fluted suction drum 4, while the cigarettes S2 forming the other cigarette row on drum 3 are transferred by the drum 3 to a turn around apparatus turning these cigarettes S2 around a transverse axis thereof, so as to orient their filters in the same direction as the filters of cigarettes S1, and which then lays them as turned around cigarettes S2' into those flutes of drum 3 that lie between the flutes being designed for receiving from drum 1 the pairs of co-axial cigarettes S1 and S2. These turned around cigarettes S2' are transferred, along with the cigarettes S1 between which they are intercalated, to drum 4, so that with these cigarettes S1 they form a row of cigarettes having their filters oriented in the same direction.

The apparatus for turning around the cigarettes S2 comprises two cooperating conical fluted suction drums 5 and 6 which are mounted in respective support members 7 and 8, diagrammatically shown by dash-and-dot lines. These conical turn around drums 5, 6 are conventional in construction and are driven through bevel gears 15, 16 which are secured on the shafts 105, 106 of said turn around drums 5, 6, and which are engaged with matching bevel gears 25, 26 fastened on a driving shaft 9. The coincidence point B of the ideal vertices of the two turn around conical drums is shifted (to the left in FIG. 1) with respect to the plane of the cut for separating the co-axial cigarette pairs S1–S2 lying in the flutes of drum 3, and of substantial abutment between these divided cigarette pairs.

Between the first conical turn around drum 5 and drum 3 there is placed a conical transfer drum 10, that also is a fluted suction drum. More particularly, in the shown embodiment the intermediate transfer drum 10 comprises an outwardly conical fluted skirt 11 which is integral of a sleeve 12 being rotatably mounted through bearings 14 on a fixed hub 13. The skirt 11 of this drum is driven in rotation by the tubular shaft 17, which through bearings 19 is rotatably mounted on the machine frame 18, and carries a bevel pinion 20 in mesh with a ring bevel gear 21 of sleeve 12. The suction ports in the flutes of the rotatable conical skirt 11 communicate—in correspondence of the arc along which the cigarettes S2 must be retained in said flutes, with a sector-shaped suction chamber 22 provided in the outer surface of a cylindrical element 23, which is fastened to the machine frame 18 and is inserted between the skirt 11 and the supporting sleeve.

Between the second turn around conical drum 6 and drum 3 there is placed a cylindrical transfer drum 24, that is a fluted suction drum. In the shown embodiment, this intermediate transfer drum 24 is integral of the flange 125 of a hub 126 which is keyed onto a driving shaft 27 being threaded co-axially through the tubular shaft 17 and being rotatably supported through bearings 28, 29, 30 in said tubular shaft 17 and in the fixed hub of the conical transfer drum 10 and, at the free end thereof, also in the machine frame 18. The skirt of the intermediate cylindrical transfer drum 24 peripherally encompasses a fixed cylindrical element 31 provided in its peripheral surface with a sector-shaped suction chamber 32 with which the suction ports provided in the flutes of the intermediate transfer drum 24 come to be connected—in correspondence of the arc along which the cigarettes S2′ must be retained in the flutes of transfer drum 24.

Both intermediate transfer drums 10, 24 and both conical turn around drums 5, 6 are constructed and arranged, and are driven—in conjunction with the activation and de-activation of suction in the flutes of drums 5, 6, 10, 24, and of drum 3, so as to achieve the following operation:

Each cigarette S2 to be turned around is taken from drum 3 by the conical transfer drum 10—and after a 180° rotation of said drum, it is handed over to the first turn around conical drum 5. During such a transfer of a cigarette S2 by means of the intermediate conical drum 10, this cigarette S2 comes to be moved to the left in figure 1, away from the cutting plane A at which the two cigarettes S1–S2 on drum 3 are substantially in mutual contact. The cigarette S2 is then handed over by the first turn around conical drum 5 to the second turn around conical drum 6, and by this latter drum to the successive intermediate cylindrical drum 24. While the cigarette S2 is travelling on the two turn around conical drums 5 and 6, the cigarette S2 is rotated by 180° about a transverse axis thereof, whereby its filter comes to be oriented in the same direction as the filters of cigarettes S1, that are transferred from drum 3 directly onto drum 4. In the meantime, the cigarette S2 is being transferred to the opposite side of plane A, in correspondence of the row formed on drum 3 by the cigarettes S1. Moreover, the cigarette S2 is moved again near the cutting plane A, at which the two co-axial cigarettes S1 and S2 on drum 3 substantially contact each other. The turned around cigarette S2′ is then put back on drum 3 by the cylindrical transfer drum 24, in correspondence of the row formed by the cigarettes S1, with its filter being oriented in the same direction as the filters of cigarettes S1, and with its ends being aligned with the ends of these cigarettes S1, more particularly, with its filter tipped end flush with the said plane A. Unlike all the other drums, either cylindrical 3, 4, or conical 10, 5, 6, that have an even number of flutes, the intermediate cylindrical transfer drum 24 has an odd number of flutes, whereby an offset of half a step is determined, and the turned around cigarettes S2′ are laid thereby into the flutes of drum 3 located between the flutes being designed for receiving the co-axial cigarette pairs S1 and S2 from drum 1. Thus, the turned around cigarettes S2′ are intercalated between the not turned around cigarettes S1 and, along with the latter, are then transferred from drum 3 to drum 4, where they form only one row of cigarettes S1, S2′ with their ends into alignment and with their filters turned in the same direction.

In lieu of turning around the cigarettes S2 of the co-axial cigarette pairs S1–S2, and of inserting them between the not turned around cigarettes S1, the cigarettes S1 of the other row may be turned around and inserted between the cigarettes S2 that will not be turned around. In this instance, the cylindrical transfer drum 24 that gave the cigarettes to drum 3, now must receive them, and the conical transfer drum 10 that received the cigarettes from drum 3, now must hand them over. The particular embodiment of the device according to the invention, as described above, and as shown in FIG. 1, permits to exchange the functions of the two intermediate transfer drums 10 and 24, without a complicated substitution of parts being required, but just by changing only the outer skirts of both intermediate transfer drums 10 and 24 and the respective inner elements 23 and 31 which control the suction as applied by the flutes. Of course, it is also possible to provide an intermediate conical transfer drum both upstream of the conical turn around drum receiving the cigarettes to be turned around, and downstream of the conical turn around drum handing over the turned around cigarettes.

What I claim is:

1. A turn around device for use with a first cigarette-carrying drum to change two side-by-side parallel rows of filter tipped cigarettes carried by the first drum, the side-by-side rows being formed by a succession of parallel pairs of co-axial cigarettes with their filters in facing relationship, into only one row of parallel cigarettes carried by the first drum with their filters oriented in the same direction, said turn around device comprising:

means for transferring cigarettes to and from said first drum; and turn around means, cooperating with said means for transferring, for turning cigarettes received from one of the two rows around by rotating the cigarettes about their transverse axes by 180° before the turned around cigarettes are inserted between the cigarettes of the other cigarette row, said turn around means including second and third cigarette-carrying drums that are disposed adjacent one another and that have frustoconical peripheries, the cigarettes being axially displaced by said second and third drums, wherein said means for transferring includes a fourth cigarette-carrying drum disposed between said first drum and one of said second and third drums, said fourth drum having a frustoconical periphery to at least partially counterbalance the axial displacement by said second and third drums, one portion of the periphery of said fourth drum being adjacent said first drum and another portion being adjacent said one of said second and third drums, and wherein said means for transferring additionally includes means for moving cigarettes between the other of said second and third drums and said first drum.

2. The device according to claim 1, wherein said fourth drum is disposed between said first and second drums and is configured to entirely counterbalance the axial displacement by said second and third drums, and wherein said means for moving comprises a fifth cigarette-carrying drum disposed between said first and third drums, said fifth drum having a cylindrical periphery.

3. The device according to claim 2, wherein said means for transferring further comprises a fixed support on which one of said fourth and fifth drums is rotatably mounted, said fixed support having an opening therein; a rotatable driving shaft on which the other of said fourth and fifth drums is mounted, said driving shaft passing through the opening in said fixed support; a rotatable tubular shaft through which said driving shaft extends; and gearing means for connecting said tubular shaft to said one of said fourth and fifth drums.

4. The device according to claim 1, wherein said drums are fluted suction drums.

5. A turn around device for use with a cigarette-carrying drum to change two side-by-side parallel rows of filter tipped cigarettes carried by the drum, the side-by-side rows being formed by a succession of parallel pairs of co-axial cigarettes with their filters in facing relationship, into only one row of parallel cigarettes carried by the drum with their filters oriented in the first direction, said turn around device comprising:

another cigarette-carrying drum disposed adjacent said drum to receive cigarettes from one of the rows, said another drum having a frustoconical periphery;

turn around means for receiving cigarettes from said another drum and rotating them by 180° about their transverse axes, said turn around means including a pair of additional cigarette-carrying drums which are disposed adjacent one another and which have frustoconical peripheries; and a further cigarette-carrying drum disposed between said turn around means and said drum to return the turned around cigarettes to the drum and deposit them between the cigarettes of the other of said rows.

6. A turn around device according to claim 5, wherein said further drum has a cylindrical periphery.

7. A turn around device according to claim 6, wherein said drum, another drum, pair of additional drums, and further drum are fluted suction drums.

* * * * *